US005135053A

United States Patent [19]

Lowther

[11] Patent Number: 5,135,053

[45] Date of Patent: Aug. 4, 1992

[54] TREATMENT OF WELL TUBULARS WITH GELATIN

[75] Inventor: Frank E. Lowther, Plano, Tex.

[73] Assignee: Atlantic Richfield Company, Los Angeles, Calif.

[21] Appl. No.: 697,543

[22] Filed: May 9, 1991

[51] Int. Cl.[5] ..... E21B 36/00; E21B 41/02

[52] U.S. Cl. ..... 166/300; 166/302; 166/310; 166/313; 166/371; 166/902; 427/239

[58] Field of Search ..... 166/300, 302, 310, 313, 166/371, 902; 106/125; 137/13; 427/11, 230, 239

[56] References Cited

U.S. PATENT DOCUMENTS

| | | | |
|---|---|---|---|
| 2,795,278 | 6/1957 | Battle | 166/902 X |
| 3,220,874 | 11/1965 | Poettmann | 427/239 X |
| 3,863,717 | 2/1975 | Cooper | 166/310 X |
| 4,003,393 | 1/1977 | Jaggard et al. | 137/15 |
| 4,039,717 | 8/1977 | Titus | 427/239 X |
| 4,216,026 | 8/1980 | Scott . | |
| 4,254,559 | 3/1981 | Puriton, Jr. . | |
| 4,264,493 | 4/1981 | Battista | 106/125 X |
| 4,266,607 | 5/1981 | Halstead | 166/902 X |
| 4,416,703 | 11/1983 | Scott . | |
| 4,473,408 | 9/1984 | Puriton, Jr. | 166/308 X |
| 4,543,131 | 9/1985 | Puriton, Jr. | 252/8.552 X |
| 5,020,561 | 6/1991 | Li | 137/13 |

FOREIGN PATENT DOCUMENTS 957910 11/1974 Canada .

OTHER PUBLICATIONS

Tiratsoo, J. N. H. "Pigging with Gelled Fluids", *Pipeline Pigging Tecnology*, May 1989, pp. 139-146.

*Primary Examiner*—George A. Suchfield

*Attorney, Agent, or Firm*—Drude Faulconer

[57] ABSTRACT

A method for treating well tubulars and elements (e.g. tubing, casing, sucker rods, etc.) for corrosion, drag reduction, or the like wherein a mass of gelatin is passed downward through the tubular to deposit a protective layer onto the wall of the tubular and/or element. Preferably, the mass of gelatin contains a treating solution therein which forms part of the protective layer. Since such treating solutions can severely damage the production and/or injection formation, the mass is stopped before it completely travels through the tubular and circulation is reversed to return any remaining mass of gelatin and solution back up the tubular towards the surface.

20 Claims, 3 Drawing Sheets

COLD GELATIN

HOT GELATIN

HOT MIXTURE

COLD MIXTURE

TREATMENT OF WELL TUBULARS WITH GELATIN

TECHNICAL FIELD

The present invention relates to the treatment of well tubulars and other well elements, e.g. sucker rods, and in one of its aspects relates to treating well tubulars and rods with gelatin which preferably contains a treating solution, e.g. corrosion inhibitor, drag reducer, etc. wherein the gelatin is passed through and/or around the element being treated to thereby deposit a layer of gelatin and treating solution onto the wall of the treated tubulars and/or other well elements.

BACKGROUND

Most production and/or injection wells are completed by cementing a string of metal casing in the borehole of the well. The casing and the surrounding cement are perforated adjacent the production and/or injection formation or formations to establish fluid communication between the formation(s) and the casing. One or more strings of metal tubing are then lowered into the casing and their lower ends are positioned adjacent the respective formations to be produced or injected. Fluids are then produced or injected through the tubing strings or, in some instances, through the annulus between the casing and the tubing. If the formation pressure is insufficient to cause the formation fluids (e.g. oil, water, etc.) to flow to the surface, a downhole pump is routinely hung on the lower end of the tubing and is operated by a string of sucker rods which extend from the surface through the tubing.

Since water is almost always present in the produced or injected fluids, corrosion is major problem in most production and injection wells. As is well known in the art, corrosion can seriously affect the operational life of the tubing strings, casing, and/or the metal sucker rods as the case may be, and if not timely treated, can cause early failure of the corroded elements. In known treatments for corrosion in wells, a slug of an appropriate liquid treating solution, e.g. corrosion inhibitor, is flowed down the tubing string. Due to the properties of the corrosion inhibitor, it adheres to the pipe wall; hopefully to form a relatively uniform layer or thin film on the entire surface of the wall to protect the wall from contact with water or other electrolytes or oxidizing agents that may be present in the fluids normally flowing through the tubing.

To insure that an adequate layer of treating solution will be deposited onto the wall as the slug passes therethrough, a substantially greater amount of corrosion inhibitor is used than is required to form the protective layer. This excess of corrosion inhibitor is not only expensive but more importantly, has been found to cause severe damage to many production and/or injection formations when it flows out the bottom of the tubing and into the formation. The real threat of formation damage severely restricts the use of this corrosion treatment which, in turn, creates a real dilemma since corrosion treatment of the well tubulars can not be ignored.

In the present inventor's co-pending U.S. patent application No. 07/683,164, filed Apr. 10, 1991, a method is set forth wherein an ablative gelatin pig containing a treating solution is passed through a tubular to deposit a protective layer onto the wall of the tubular which is similar to method of the present invention.

SUMMARY OF THE INVENTION

The present invention provides a method for treating well tubulars and elements (e.g. tubing, casing, sucker rods, etc.) for corrosion, drag reduction, or the like wherein a mass of gelatin is passed downward through the tubular to deposit a protective layer onto the inner wall of the tubular. Preferably, the mass of gelatin contains a treating solution therein which is deposited along with the gelatin to form a part of the protective layer. Since such treating solutions are usually highly detrimental and damaging to the production and/or injection formation in the well, the mass of gelatin and solution is stopped before it completely travels through the tubular and circulation is reversed to return any remaining mass of gelatin and solution back up the tubular towards the surface. Preferably, the mass is sized so that all of the gelatin and treating solution is deposited onto the tubular wall or is otherwise used up before it reaches the surface.

More specifically, in accordance with the present invention a mass of gelatin preferably containing a treating solution is positioned within a well tubular at the surface. This mass is formed by mixing common gelatin (e.g. commercial grade A or B gelatin) with a heated liquid (at about 170° F.) which preferably contains a treating solution (e.g. corrosion inhibitor, drag reducer, etc.). The mass is preferably formed in situ within the tubular and can be passed through the tubular either in an ungelled state or it can be allowed to cool to form a gelled pig before it is passed through the tubular. Further, if it is to be used as a gelled pig, the pig can be molded externally and then inserted into the tubular.

In some applications (e.g. high temperature wells), a hardener (e.g. an aldehyde) is used to strengthen the protective layer and to increase the temperature at which the gelatin in the layer will melt. The hardener can be added to the gelatin-heated liquid mass or it can be flowed through the tubular behind the mass.

In other embodiments of the present invention, a mass of gelatin-treating solution is positioned into the annulus of the well (both single and multi-completed wells) and in contact with both the inner wall of the casing and the outer wall(s) of the tubing(s). The mass is passed downward through the annulus to deposit a protective layer on both the casing and the tubing walls. Also, in one embodiment, a mass of gelatin-treating fluid is passed down the tubing of a pumping well between the inner wall of the tubing and a string of sucker rods to deposit a protective layer on both the inner wall of the tubing and the outer surface of the rods.

BRIEF DESCRIPTION OF THE DRAWINGS

The actual construction, operation, and apparent advantages of the present invention will be better understood by referring to the drawings in which like numerals refer to like parts and in which.

BEST KNOWN MODE FOR CARRYING OUT THE INVENTION

In accordance with the present invention, a method is provided for treating well tubulars and other well elements, e.g. sucker rods, wherein a relatively thin film or layer of a treating solution is deposited onto the wall of the well tubular or other element by a mass as it passes through the tubular and/or around the other element. As used herein, "tubular" is intended to include any pipe or conduit (e.g. casing, tubing, etc.) through which fluids and particulates are flowed. While the present invention will be described primarily in relation to a substantially vertical well, it should be recognized that the invention is equally applicable for use substantially horizontal and/or inclined well casings and tubings.

In the present invention, a mass (i.e. a liquid slug or a gelled "pig") of gelatin is used to deposit a protective layer or film on the well tubular or element. Gelatin is a material which is capable of recovering from large deformations quickly and forcibly which allows a pig formed of gelatin to easily negotiate bends, constrictions, and the like in a tubular. Due to the ambient heat in the well tubulars and/or the heat generated by the moving slug or pig against the wall of the pipe, the gelatin "ablates" to deposit a layer of gelatin and any treating solution contained therein onto the tubular or element, as will be further explained below.

As is well known, "gelatins" are high molecular weight polypeptides derived from collagen which, in turn, is the primary protein component of animal connective tissue (e.g. bones, skin, hides, tendons, etc.). Gelatin, which is commonly used in foods, glues, photographic and other products, does not exist in nature and is a hydrolysis product obtained by hot water extraction from the collageous raw material after it has been processed with acid, alkaline, or lime. The viscosity of aqueous gelatin solutions increases with increasing concentrations and decreasing temperatures. For a more complete description and discussion of gelatin, its compositions and properties, see ENCYCLOPEDIA 0F CHEMICAL TECHNOLOGY, Kirk-Othmer, 3rd Edition, vol. 11, J. Wiley & Sons, N.Y., pps. 711 et sec.

Figure 1:
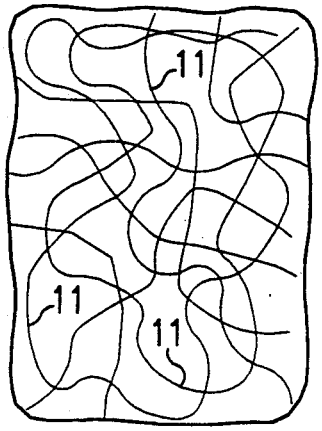
FIG. 1 is an idealized representation of gelatin molecules in a cooled aqueous solution.
Figure 2:
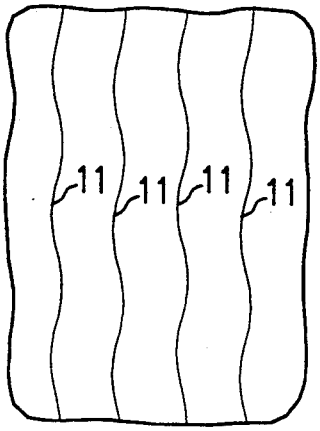
FIG. 2 is an idealized representation of the gelatin molecules of FIG. 1 in a heated state.
Figure 3:
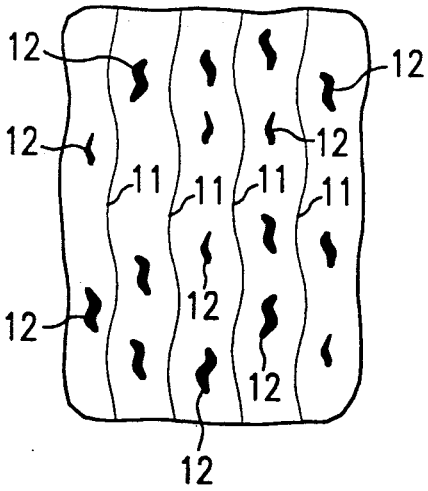
FIG. 3 is an idealized representation of the heated gelatin molecules of FIG. 2 with molecules of a treated solution blended therein.
Figure 4:
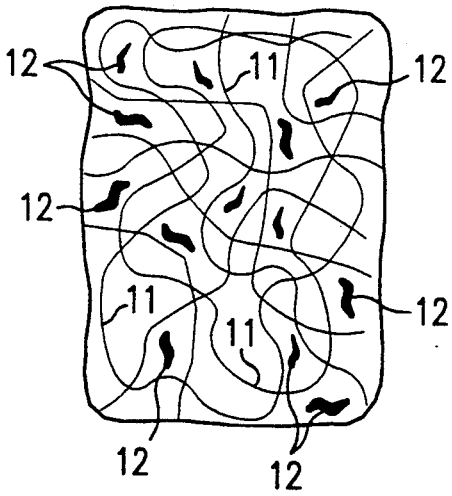
FIG. 4 is an idealized representation of the gelatin and treating solution molecules of FIG. 3 after cooling.

While gelatin, itself, acts as a treating agent, (e.g. as a corrosion inhibitor and/or a drag reducer) preferably, a separate treating solution is incorporated into the gelatin in the present invention. Referring now to the drawings, FIG. 1 is a highly idealized representation of an aqueous solution of gelatin molecules 11 as they appear in a cooled state while FIG. 2 represents the molecules as they appear when heated (e.g. above 180° F.). Molecules of a treating solution 12 are blended into the hot gelatin solution (FIG. 3) and are trapped therein by the gelatin molecules 11 as the gelatin-treating solution is cooled back to room temperature (FIG. 4).

In the present invention, if the treatment of a tubular is primarily to inhibit corrosion, the treating solution 12 is comprised of almost any known corrosion inhibitor of the type used to treat tubulars. Examples of good corrosion inhibitors are (1) an aqueous blend of fatty acid imidazoline quaternary compound and alcohol, e.g. commercially-available as NALCO 3554 INHIBITOR; (2) an alkylamide polyamide fatty acid sulfonic acid salt in a hydrocarbon solvent, e.g. VISCO 945 CORROSION INHIBITOR; (3) an imidazoline fatty acid, e.g. OFC C-2364 CORROSION INHIBITOR. For examples of other corrosion inhibitors, see co-pending U.S. patent application Ser. No. 07/566,186, filed Aug. 13, 1990 and commonly-assigned with the present invention.

If the treatment of a well tubular is primarily to reduce drag, any known drag reducer of the type used to reduce drag in tubulars can be incorporated into the gelatin pig. For example, many of the above-identified corrosion inhibitors are also good drag reducers thereby producing the combined benefits of reducing drag and inhibiting corrosion. Also, high molecular weight (e.g. $10^6$) homopolymers, e.g. polyethylene oxide, are good drag reducers in that the high weight molecules at least partially "fill" any indentations in the pipewall to "smooth" out the roughness of the wall thereby reducing drag between the pipewall and the flowing fluids. Other treating solutions such as biocides, herbicides, etc. also can be incorporated into the gelatin if desired for a particular treatment.

When formulating a gelled gelatin pig in accordance with the present invention, it has been found that the hardness (i.e. firmness of the cooled gelatin) is primarily dependent on the amount of gelatin in the pig and is relatively independent on the composition of the water/treating solution used with the gelatin. For example, a pig formed with approximately 17% gelatin and a liquid comprised of 30% water and 70% treating solution (e.g. NALCO 3554 INHIBITOR) has substantially the same hardness as that of a pig formed with the same amount of gelatin and a liquid comprised of 70% water and 30% treating solution (NALCO 3554). While it should be recognized that the exact formulation of a particular gelatin pig may vary with the actual components used, the environment in which the pig is to be used, the treatment to be carried out, etc., the following example illustrates a typical composition for a gelled gelatin pig in accordance with the present invention:

100 parts of a treating solution (e.g. NALCO 3554) is mixed thoroughly with 100 parts by weight of hot water (180° F.). 60 parts by weight of gelatin is blended into the hot liquid mixture. The temperature of the gelatin-liquid mixture at this point should be at least 170° F. The gelatin-liquid mixture is allowed to cool to ambient temperature (e.g. room temperature) to thereby form the gelatin mass which becomes the pig. The gelatin-hot liquid mixture may be poured into an appropriate mold where it is allowed to cool to produce a pig basically in the shape of the mold which, in turn, is designed for a particular application. If a slug of ungelled gelating is to be used, this same formulation is applicable except the gelatin is not allowed to cool.

Figure 5:
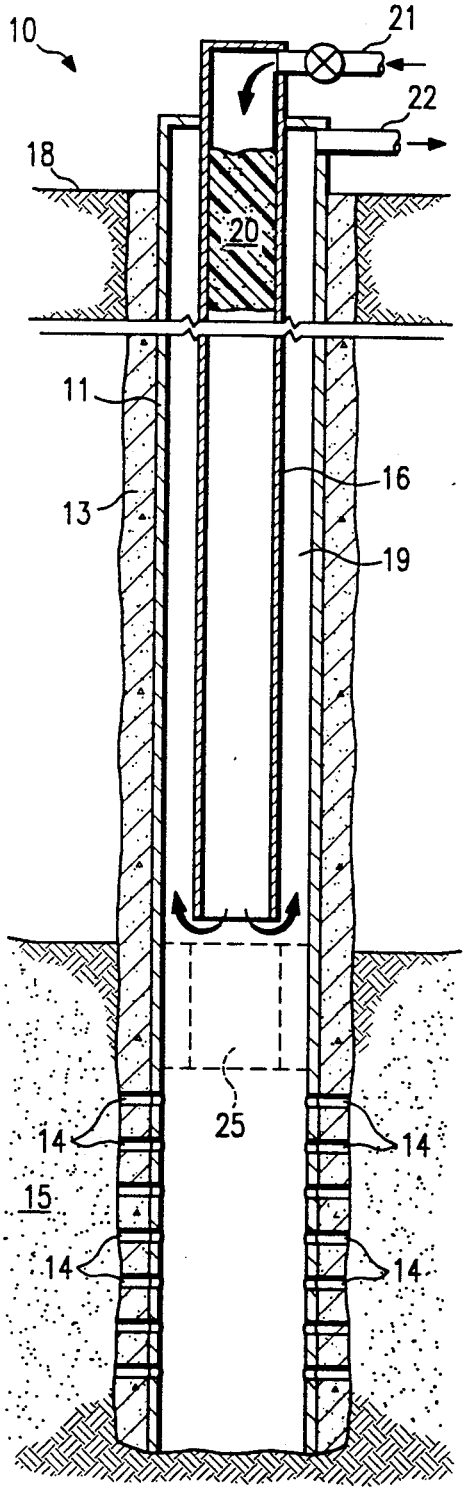
FIG. 5 is a sectional view, partly broken away, of a well having a slug of gelatin within the upper end of a tubing string in accordance with the present invention.

Referring again to the drawings, FIG. 5 illustrates a well 10 having a casing 11 secured in the borehole by cement 13, both of which have perforations 14 therethrough adjacent production and/or injection formation 15. A string of tubing 16 extends from a wellhead at the surface 18 to a point adjacent perforations 14 and forms an annulus 19 with casing 11.

In accordance with the present invention, well 10 is shut-in and a mass of gelatin-hot liquid mixture 20 (e.g. 170°) is flowed into tubing 16 through line 21. The gelatin-hot liquid 20 will come to rest on the head of production/injection fluid which is present in tubing 16 when the well is shut-in. While it is preferable to allow the gelatin-hot liquid mixture to cool to form a gelled pig, it should be recognized that the gelatin-hot liquid mixture may also be flowed through tubing 16 as in an ungelled state, if desired, to deposit a protective layer onto the inner wall of the tubing. In either case, the mass of gelatin is passed downward in tubing 16, preferably by flowing fluid (e.g. production or injection fluids) into tubing 16 on the top of the mass of gelatin 20. The fluids in the tubing below mass 20 will be pushed ahead of the gelatin and will either be forced through perforations 14 into formation 15 or returns can be taken through annulus 19 and line 22 at the surface.

As the mass of gelatin 20 passes through tubing 16, it will deposit a protective layer of comprised of gelatin and treating solution onto the inner wall of the tubing. Where the gelatin is cooled into a gelled mass, it is easily deformable to conform to the diameter of tubing 16. The gelled mass (i.e. pig) can be formed in situ as described above but it can also be formed in a mold and then inserted into the tubular. If a pig is formed externally and has a diameter which is larger than the tubing, its compliancy allows it to easily deform so that it can be inserted into the tubing.

The pressure from the fluids being pushed ahead of mass 20 acts on the leading edge of the mass while the pressure of the fluids behind the mass acts on the rear edge. These opposite acting pressures push towards each other along the longitudinal axis of the mass which radially-expands the gelatin 20 thereby continuously forcing the periphery of mass 20 into contact with the tubing at all times, even as the material in the mass is being deposited onto the wall. This is true regardless whether the diameter of a gelled pig is smaller, larger, or approximately the same as the diameter of the tubing so that the pig is always in contact with the wall during operation.

The temperature of the tubing 16 and/or the heat generated by gelled mass 20 as it moves along in contact with the inner wall of tubing 16 causes the gelatin pig to ablate thereby depositing a layer 23 (FIG. 6) of combined gelatin and treating solution onto the tubing wall. The temperature at which a typical gelled gelatin pig ablates is around 100° F.

Due to the possibility of damage to the formation, it is desirable to prevent the treating fluid, e.g. corrosion inhibitor, in the mass of gelatin 20 from entering into formation 14. In accordance with the present invention, pumping of fluid through tubing 16 behind the mass 20 is halted before the mass 20 passes completely through the tubular (e.g. as it nears the bottom of tubing 16 (FIG. 6)) and the circulation of fluids is reversed by pumping fluids down annulus 19 and taking returns through the tubing. If the production or injection interval is normally packed off by a tubing packer 24, the packer is released to allow circulation through the annulus. If the tubing is normally landed in a tubing seating nipple (dotted lines 25 in FIGS. 5 and 6) or the like, the tubing is raised above same to allow circulation through the annulus. Reverse circulation results in forcing mass 20 back up through the casing during which time additional material from the mass is deposited onto the wall of tubing 16, thereby providing additional thickness to the protective layer 23. The mass 20 is preferably sized so that it will effectively be used up before it again reaches the surface.

In some well tubular treatments, the ambient temperature in the tubular may be high enough (e.g. substantially above 100° F.) to seriously affect the ability of layer 23 to adhere to the wall after it has been deposited thereon. That is, excessive temperatures may cause the gelatin in layer 23 to "melt" and be swept away by the fluids flowing in the pipeline. Accordingly, in accordance with one embodiment of the present invention, a "hardener" is used to react with the gelatin to protect the gelatin against softening or melting at the well temperatures. The hardener strengthens the gelatin in layer 23 and makes it resistant to abrasion. It also increases the apparent viscosity of the gelatin and the temperature at which the gelatin will melt.

Examples of such hardeners (e.g. formaldehydes) are those used to harden gelatin in photography applications, see THE THEORY OF THE PHOTOGRAPHIC PROCESS, Third Edition, The Macmillan Co., N.Y. Chapter 3, pps. 45–60. The hardener may be added to the mass of ungelled gelatin or to the gelatin-hot liquid mixture during the formation of the a pig to control the melting or ablating point of the pig, itself, and/or a slug of hardener can be pumped behind the mass of gelatin 20 whereby the hardener comes into contact and reacts with the gelatin after layer 23 has been deposited onto the wall.

Figure 6:
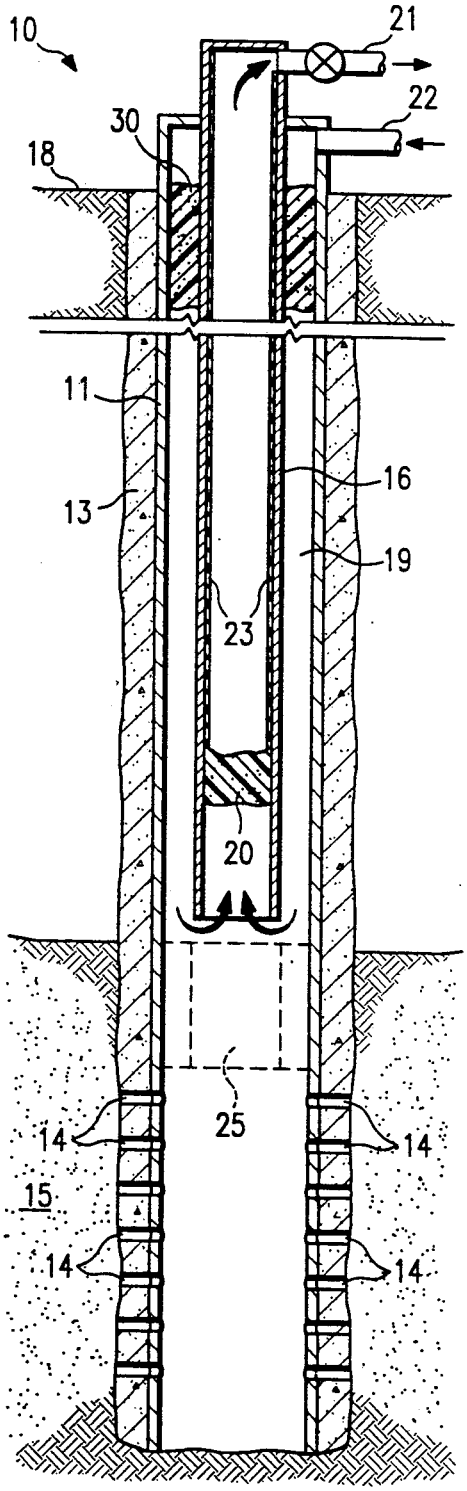
FIG. 6 is a sectional view similarly to FIG. with the mass of gelatin in the lower end of the tubing string.

FIG. 6 also illustrates a further embodiment of the present invention wherein a mass 30 of gelatin which can include a treating solution is positioned in annulus 19 of well 10 so that it is in contact with both the outer surface of tubing 16 and the inner surface of casing 11. Now as the mass 30 is passed downward in annulus 19, it coats both the inner surface of casing 11 and the outer surface of tubing 16 with respective protective layers of gelatin and the treating solution, e.g. corrosion inhibitor. The compliancy of the gelatin allows it to conform against both surfaces and easily negotiate any couplings, bends, etc. that may be present in either the casing or the tubing.

Figure 7:
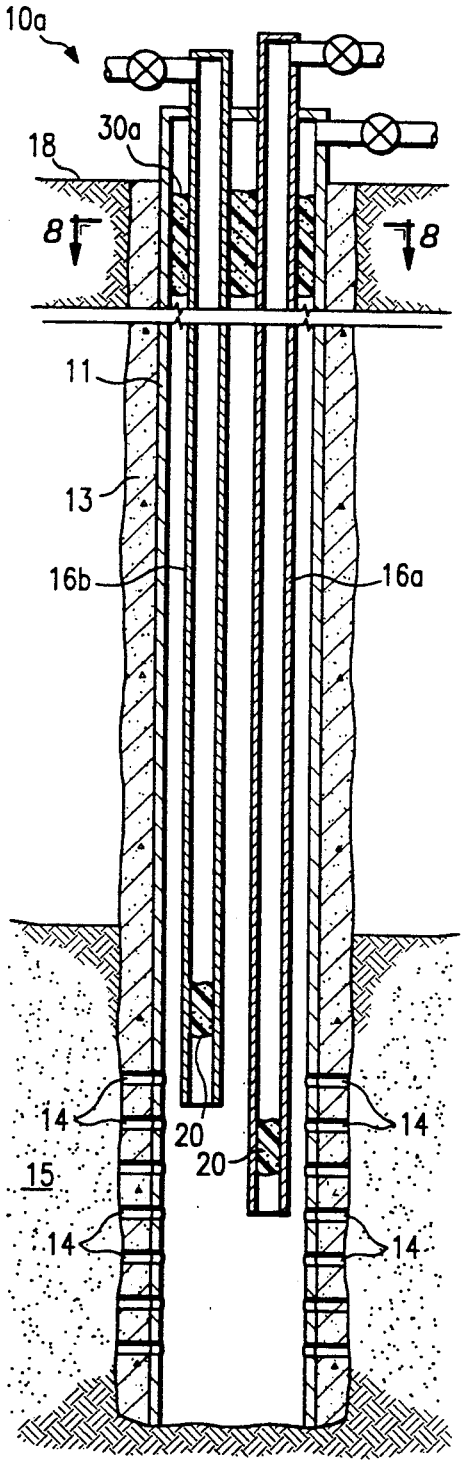
FIG. 7 is a sectional view of the present invention in a multi-completed well.
Figure 8:
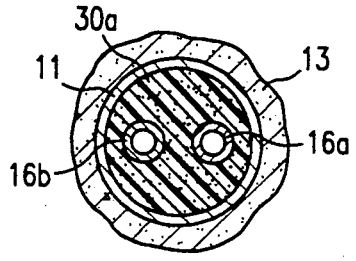
FIG. 8 is across-sectional view taken along line 8—8 of FIG. 7.

Again, circulation is reversed as mass 30 nears the bottom of tubing 16 to prevent any of the undesirable corrosion inhibitor from entering and damaging formation 15. As the reverse circulation forces the remaining mass 30 back up the annulus, additional material from mass 30 is deposited onto the walls thereby thickening the protective layers already in place. A similar embodiment is disclosed in FIGS. 7 and 8 wherein a mass of gelatin **30*a* is positioned in the annulus 19*a* of a multi-completed well 10*a* having a plurality of tubing strings 16*a*, 16*b* therein. The compliancy of the mass 30*a* assures contact with both the outer surfaces of both tubing strings and the inner surface of casing 11*a*** during both direct and reverse circulation of the gelatin through the borehole.

Figure 9:
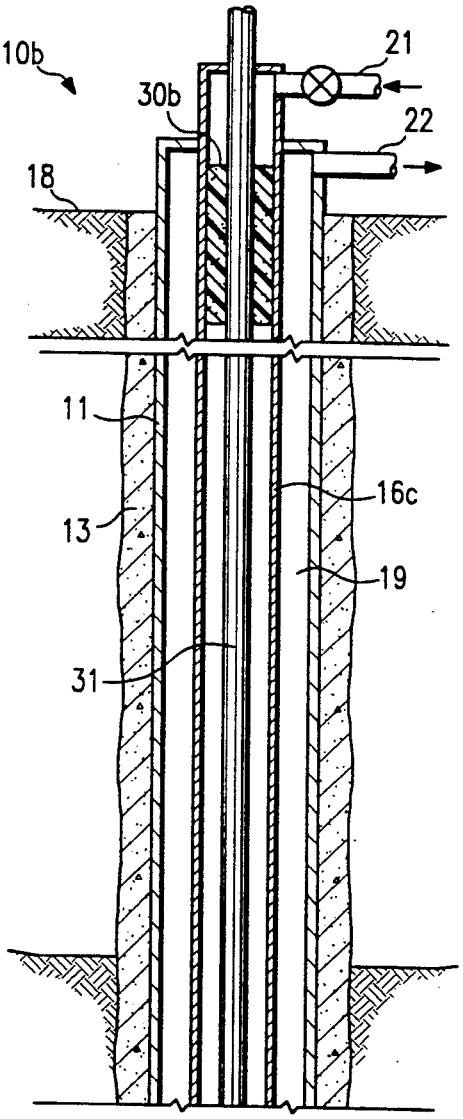
FIG. 9 is a sectional view, partly broken away of a mass of gelatin surrounding a string of sucker rods in the tubing of a pumping well.

FIG. 9 illustrates a pumping well **10*b* having a string of sucker rods 31 extending through tubing 16*c* to operate a downhole pump which is suspended on the lower end of the tubing (not shown). Mass of gelatin 30*b* is positioned within tubing 16*c* and surrounds rods 31 so that when the mass 30*b* is pumped down the tubing, it will deposit a protective layer of gelatin and treating solution onto both the inner surface of tubing 16*c* and the outer surface of rods 31. When the mass 30*b* reaches the bottom of tubing 16c, the pump (not shown) is started to pump the material remaining in mass 30b** back up the tubing.

What is claimed is:

1. A method for treating a tubular in a well comprising:

passing a mass of gelatin downward through said tubular wherein said mass of gelatin contacts the inner wall of said tubular and deposits a protective layer on said wall; and stopping said mass of gelatin before it travels completely through said tubular; and passing said mass of gelating, upward in said well tubular toward the surface.

2. The method of claim 1 wherein said mass of gelatin is a gelled pig.

3. The method of claim 2 wherein said mass of gelatin is formed by mixing gelatin with a heated liquid.

4. The method of claim 3 wherein said liquid includes: a treating solution.

5. The method of claim 3 wherein said treating solution comprises:

a corrosion inhibitor.

6. The method of claim 3 wherein said treating solution comprises:

a drag reducer.

7. The method of claim 3 wherein said heated liquid is at a temperature of about 170° F.

8. The method of claim 2 wherein said mass of gelled gelatin is formed by mixing gelatin with a heated liquid which is then allowed to cool to ambient temperature.

9. The method of claim 8 wherein said heated liquid is at a temperature of about 170° F. and said ambient temperature is less than about 100° F.

10. The method of claim 8 wherein said pig is formed by allowing the gelatin-heated liquid mixture to cool in a mold before it is inserted into said well tubular.

11. The method of claim 8 wherein said gelatin and heated liquid are mixed in said tubular and allowed to cool therein to form said pig in situ in said tubular.

12. The method of claim 1 wherein said mass of gelatin is a ungelled liquid slug.

13. The method of claim 1 including:

adding a hardener to said mass of gelatin for increasing the strength of said protective layer.

14. The method of claim 13 wherein said hardener comprises:

an aldehyde.

15. The method of claim 2 including;

passing a solution containing a hardener through said well tubular behind said mass of gelatin to react with said protective layer on said wall to increase the strength of said layer.

16. A method of treating tubulars in a cased well having at least one string of tubing therein, said method comprising:

positioning a mass in the annulus formed between said casing and said at least one string of tubing, said mass comprising common gelatin containing a treating solution; and passing said mass downward in said annulus and in contact with both the inner wall of said casing and said outer wall of said tubing to deposit a protective layer on each of said walls.

17. The method of claim 16 wherein said mass of gelatin includes a treating solution.

18. The method of claim 16 wherein said well has more than one strings of tubing.

19. A method of treating tubulars in a pumping well having a string of tubing and a string of sucker rods extending through said tubing, said method comprising:

positioning a mass in the annulus formed between said tubing and said rods, said mass comprising common gelating containing a treating solution; and passing said mass downward in said annulus and in contact with both the inner wall of said tubing and said outer wall of said rods to deposit a protective layer on each of said walls.

20. The method of claim 19 wherein said mass of gelatin includes a treating solution.

* * * * *